US008678195B2

(12) United States Patent
Azzolin et al.

(10) Patent No.: US 8,678,195 B2
(45) Date of Patent: Mar. 25, 2014

(54) SCREENING BUCKET

(75) Inventors: Guido Azzolin, Breganze (IT); Diego Azzolin, Breganze (IT)

(73) Assignee: Meccanica Breganzese S.p.A. in Breve MB S.p.A., Fara Vicentino (VI) (IT)

( * ) Notice: Subject to any disclaimer, the term of this patent is extended or adjusted under 35 U.S.C. 154(b) by 0 days.

(21) Appl. No.: 13/809,614

(22) PCT Filed: Jul. 14, 2011

(86) PCT No.: PCT/IB2011/053153

§ 371 (c)(1),
(2), (4) Date: Jan. 11, 2013

(87) PCT Pub. No.: WO2012/007921

PCT Pub. Date: Jan. 19, 2012

(65) Prior Publication Data

US 2013/0105368 A1 May 2, 2013

(30) Foreign Application Priority Data

Jul. 15, 2010 (IT) ..... PD2010A0221

(51) Int. Cl.

| | |
|---|---|
| ***B07B 1/00*** | (2006.01) |
| ***B07B 1/22*** | (2006.01) |
| ***B07B 1/28*** | (2006.01) |
| ***B07B 1/24*** | (2006.01) |

(52) U.S. Cl.
USPC ..... 209/235; 209/288; 209/252; 209/297

(58) Field of Classification Search
USPC ..... 209/288, 303, 44.3, 270, 687, 689, 552, 209/597, 235; 460/81
See application file for complete search history.

(56) References Cited

U.S. PATENT DOCUMENTS

| | | | | | |
|---|---|---|---|---|---|
| 1,467,348 | A | * | 9/1923 | Young | 209/270 |
| 2,282,530 | A | * | 5/1942 | Plass | 69/23 |
| 2,290,315 | A | * | 7/1942 | Cline et al. | 209/247 |
| 3,002,623 | A | * | 10/1961 | Fontaine | 209/288 |
| 3,073,449 | A | * | 1/1963 | Johanningmeier | 209/288 |
| 3,208,593 | A | * | 9/1965 | Dietert | 209/288 |
| 3,363,344 | A | | 1/1968 | Howard et al. | |
| 4,457,435 | A | * | 7/1984 | Truman | 209/683 |
| 5,002,656 | A | * | 3/1991 | Johansson | 209/421 |
| 5,078,903 | A | * | 1/1992 | Burgess | 210/781 |
| 5,732,827 | A | * | 3/1998 | Dorscht | 209/284 |
| 5,733,450 | A | * | 3/1998 | Langner | 210/403 |
| 6,019,227 | A | * | 2/2000 | May, III | 209/284 |
| 7,080,741 | B1 | * | 7/2006 | Butzin et al. | 209/664 |

FOREIGN PATENT DOCUMENTS

| | | | |
|---|---|---|---|
| EP | 0284643 | A1 | 10/1988 |
| EP | 1577023 | A1 | 9/2005 |
| JP | 2004237221 | A | 8/2004 |
| JP | 2009262039 | A | 11/2009 |

* cited by examiner

*Primary Examiner* — Patrick Cicchino
(74) *Attorney, Agent, or Firm* — Volpe and Koenig, P.C.

(57) ABSTRACT

A screening bucket includes a support structure securable to the moving arm of an operating machine, a screening drum secured to that structure allowing it to rotate about an axis, a rotation unit for the screening drum and switching device for the rotation unit that switches the rotation unit between a first operating mode in which the screening drum is set in rotation at a substantially constant predetermined working speed and a second operating mode in which the rotation speed of the screening drum is reduced. The rotation unit further includes a detector assembly for detecting an angular position of the drum, cooperating with the switching device such that the rotation unit is automatically brought into the second operating mode when the drum is situated in the region of at least one predetermined portion of a revolution.

18 Claims, 4 Drawing Sheets

SCREENING BUCKET

Figure 1:
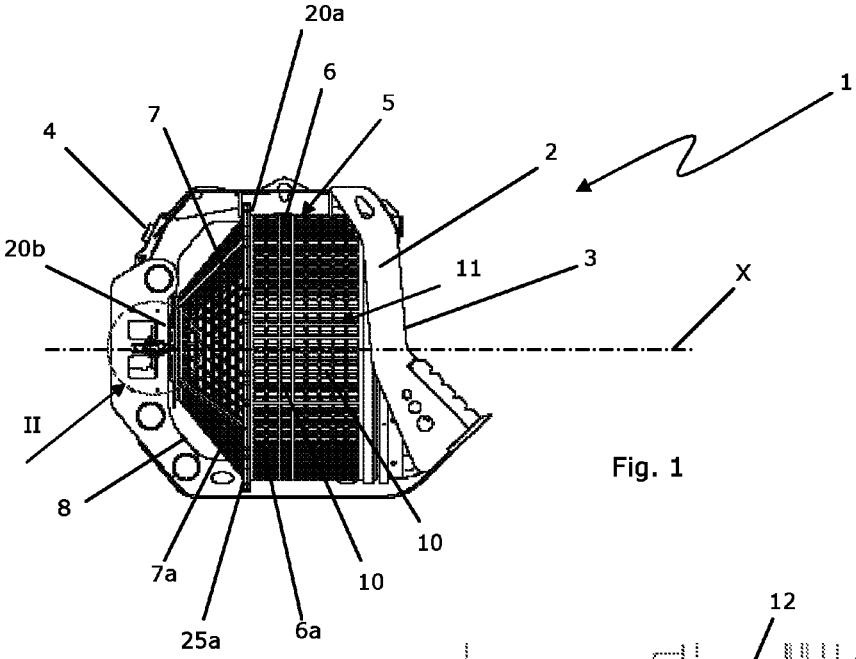

The present invention relates to a screening bucket of the type including the features described in the preamble of the main claim.

Buckets of the aforesaid type can be fitted to the end of the arm of an operating machine and make it possible to select and separate from a single heap the stone-like material resulting from excavation or demolition.

Typically, a screening bucket consists of an outer structure which can be connected to the end of an operating machine arm and of a drum which rotates within the fixed structure, receiving the rotational drive from a system comprising a reduction gear and a hydraulic motor supplied by the hydraulic system of the operating machine.

The drum comprises in its outermost part a mesh with openings of dimensions that are suitably selected to allow only the passage of material of dimensions below a predetermined size.

During the rotation of the drum, the material inside it is also set in rotation in such a way as to be brought into contact with the mesh and separated according to the dimensions of the material itself: the material of smaller size than the dimensions of the drum mesh drops through the bucket, and that of larger size remains inside the drum.

When screening is completed, the material remaining inside the drum is discharged and the machine is ready for a fresh cycle.

An example of a screening bucket is described in patent application EP 0284 643.

One of the problems associated with such devices is linked to the accumulation of material in the region of the lateral walls of the drum, which takes place as a result of the rotation of the latter. It is clear that by increasing the speed of rotation of the drum, on the one hand greater productivity will be obtained, understood as the amount of material screened per unit of time, and on the other hand there will be a greater accumulation of material of larger size in the region of the lateral walls of the drum. This excessive accumulation tends to prevent the correct emergence of the material of smaller size, and in fact represents a limitation for the productivity of the system. Consequently, the rotation speed of the drum must be kept within certain limits in order to limit this accumulation phenomenon.

Besides such bucket systems, other screening systems are also known, such as, for example, that described in European Patent Application EP 1 577 023.

In particular, that patent application describes a rotatable screening drum of cylindrical shape mounted on a mobile means.

This device also is still subject to the same accumulation problems described with reference to screening buckets.

In general, therefore, the known screening buckets, which are in themselves functional and fulfil market requirements, do however employ stratagems which can be improved, in particular with regard to the efficiency of the screening operation.

It is an aim of the present invention to provide a screening bucket of the aforesaid type structurally and functionally designed in such a way as to make it possible to remedy all the drawbacks mentioned with reference to known screening buckets.

This task, with this and other aims, is achieved by the invention by means of a screening bucket produced in accordance with the attached claims.

Figure 2:
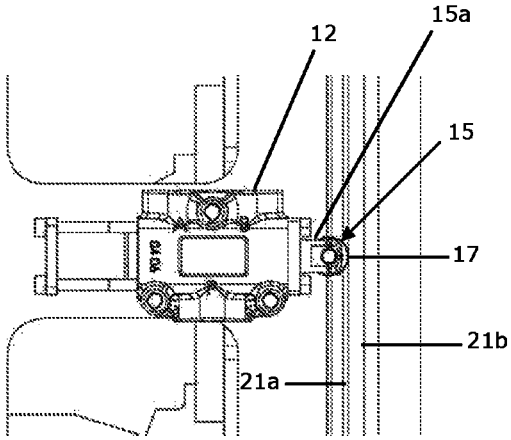
Figure 3:
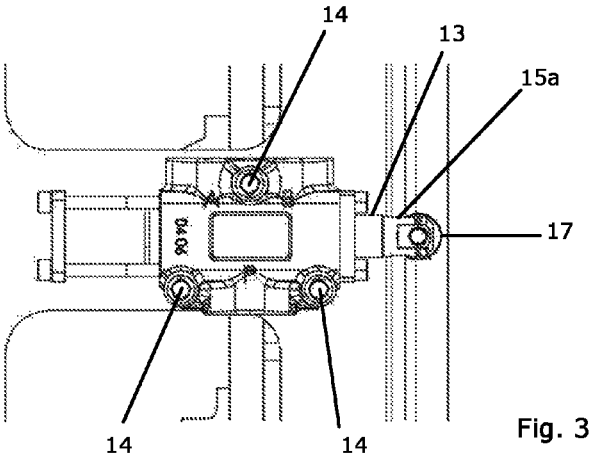
Figure 5:
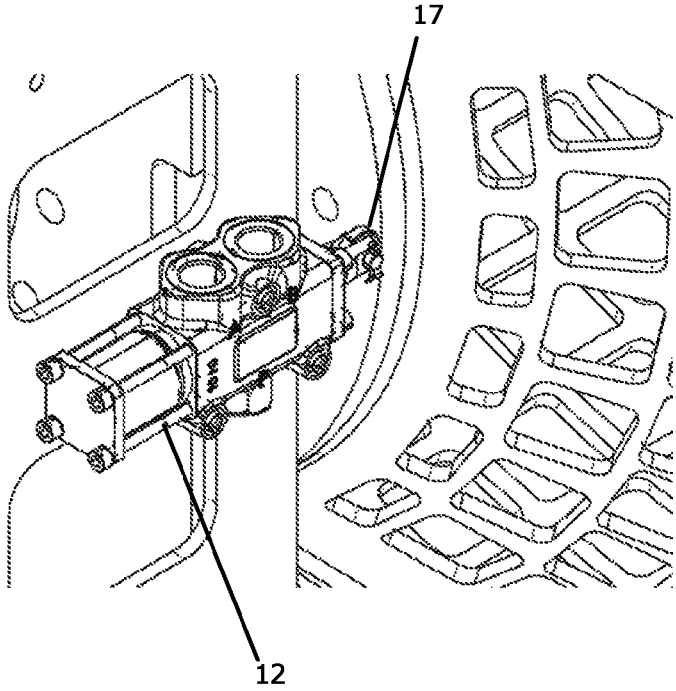
Figure 4:
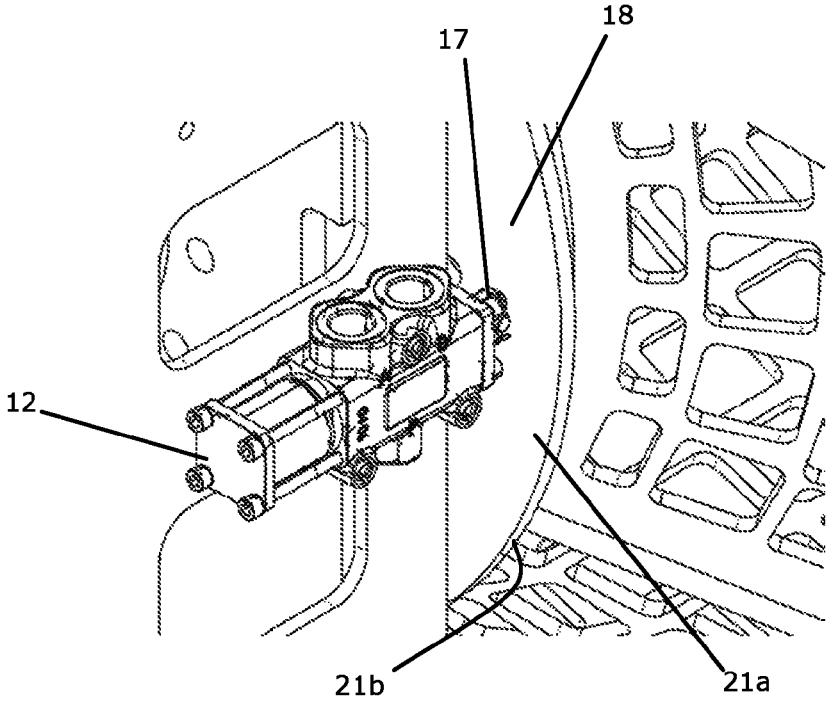
Figure 6:
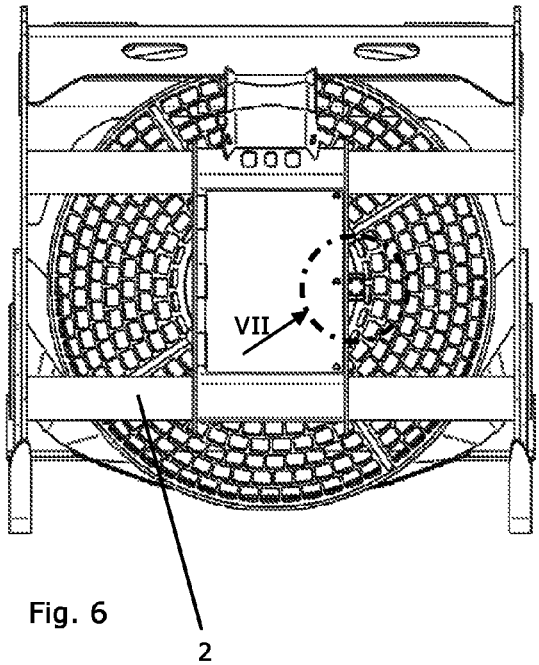
Figure 7:
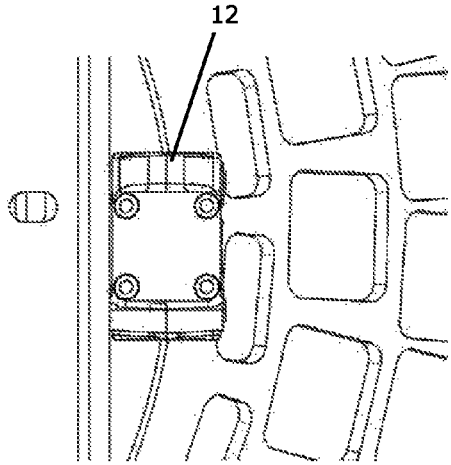
Figure 8:
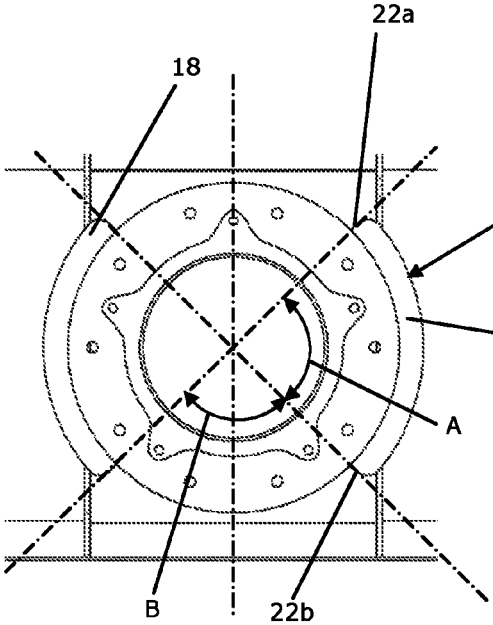
Figure 9:
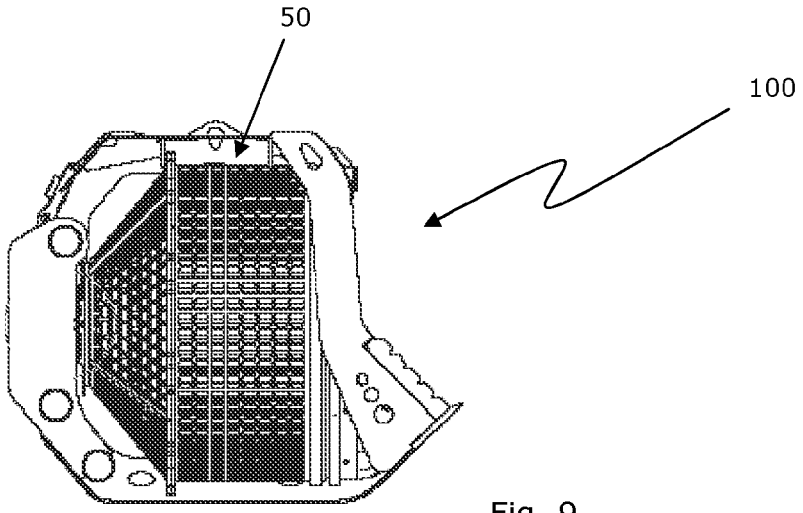
Figure 10:
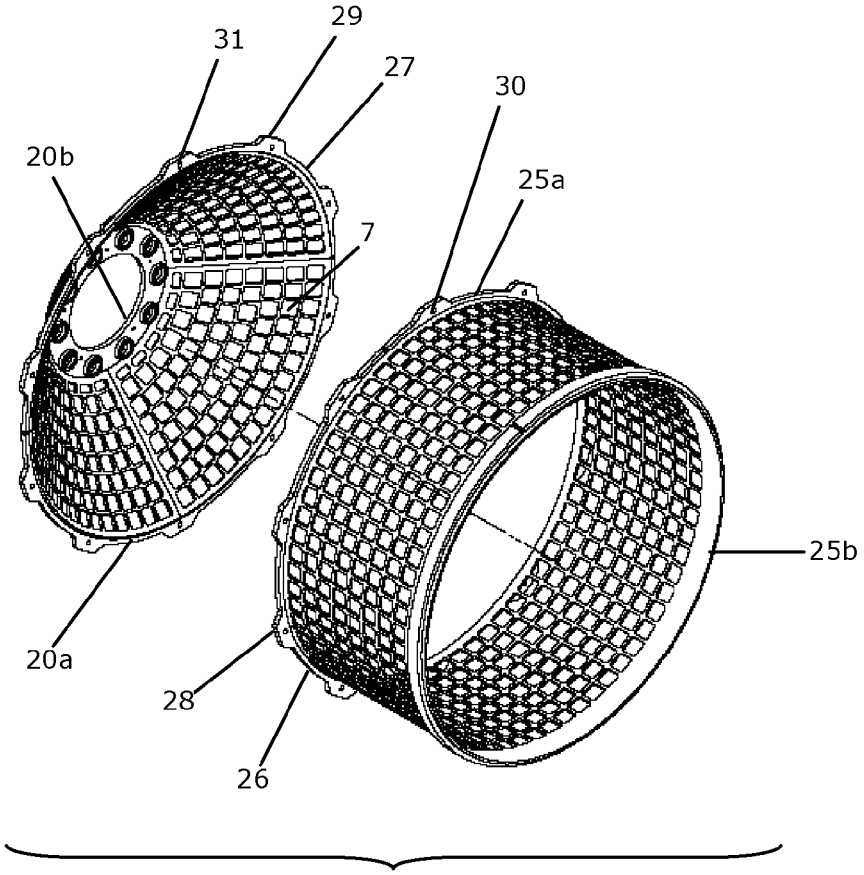

The features and advantages of the invention will become clearer from the detailed description of a preferred, but not exclusive, example thereof, illustrated by way of non-limiting example with reference to the attached drawings in which:

FIG. 1 is a side view of a screening bucket according to the present invention, FIG. 2 is a view of the detail II of FIG. 1, FIG. 3 is a side view of the detail of FIG. 2 in a different operating configuration, FIGS. 4 and 5 are two axonometric views respectively of the detail of FIGS. 2 and 3, FIG. 6 is a rear view of the bucket of FIG. 1, FIG. 7 is a view of the detail VII of FIG. 6, FIG. 8 is a rear view of a detail of the bucket of FIG. 1, FIG. 9 is a side view of an alternative embodiment of a screening bucket according to the present invention, FIG. 10 is an exploded view of a detail of the bucket of FIG. 9.

With initial reference to the attached FIGS. 1-8, the reference 1 indicates as a whole a bucket for screening inert material, such as crushed stone or similar material, produced according to the present invention.

The bucket 1 comprises an outer structure 2, generally shovel-shaped, in which is defined an inlet opening 3 for loading the material to be screened and for discharging the material retained in the bucket after screening.

On the upper part of the outer structure 2 an attachment system 4 is provided for hooking the bucket 1 on to the free end of an arm (not shown) of an operating machine.

The bucket 1 further comprises a screening drum 5 axially symmetrical with the axis X of symmetry. The screening drum 5 comprises a first lateral cylindrical portion 6 and a second frustoconical base portion 7 adjacent to each other and both having the axis X as axis of symmetry. The second portion 7 is provided with two circular bases 20*b,a*, respectively minor and major, with the major base 20*a* adjacent to the first cylindrical portion 6 and having the same diameter as the latter.

The first and second portions 6, 7 are constituted by two respective metal walls 6*a*, 7*a* suitable for bounding the screening drum 5 about its perimeter and provided with a plurality of holes 10 arranged in a mesh 11 of dimensions such as to permit the passage of stone-like material of a predetermined size through the metal walls 6*a*, 7*a*.

The screening drum 5 is housed inside the structure 2 with the first portion 6 facing towards the inlet opening 3 and the second portion 7 facing towards a base 8 of the structure 2, opposite the inlet opening 3.

The screening drum 5 is secured to the structure 2 so that it may rotate about its axis of symmetry X, in such a way as to facilitate the screening of the stone-like material inside the screening drum 5.

The bucket 1 comprises a rotation unit, not illustrated in the drawings, for the screening drum 5 for imparting a rotational movement of the drum 5 about its axis X of rotation. In particular, the rotation unit can operate selectively according to a first operating mode, in which the screening drum 5 is set in rotation at a substantially constant predetermined working speed, and according to a second operating mode, in which the rotation speed of the screening drum 5 is reduced. Switching between the first and the second operating mode takes place by means of switching means 12 which, in the present form of embodiment, alternate the functioning of the rotation unit between the two modes, reducing the rotation speed of the drum at predetermined intervals.

In more detail, in the present form of embodiment the rotation unit of the screening drum is formed by a hydraulic motor actuated by a hydraulic circuit which can be connected to the main hydraulic system of an operating machine and which can be connected to the screening drum 5 in order to actuate the rotation thereof about the axis X.

The hydraulic circuit, which is otherwise known and therefore not described or illustrated, comprises a valve 12 for supplying a variable flow rate of operating fluid to the hydraulic motor of the hydraulic circuit, coming from the hydraulic system of the operating machine. The valve 12, together with actuator means and counter-means which will be described hereinafter, provides the switching means for the rotation unit in the present form of embodiment.

The valve 12 is fixed to the structure 2, in the region of the base 8 in a position radially spaced apart from the axis X of rotation, by means of a plurality of screws 14 (three screws 14 in the example in the drawings).

When the valve 12 is open, the screening drum 5 is connected to the hydraulic circuit in such a way that the latter can transmit the motion to the screening drum, at a desired rotation speed. On the other hand, when the valve 12 is at least partially closed, a lesser fluid flow rate is supplied to the motor of the screening drum 5, which therefore reduces its rotation speed. It is also clear that when the valve 12 is completely closed, the motor is disconnected from the hydraulic circuit and, in this way, the screening drum 5 can rotate only by its own inertia, thus reducing its rotation speed. In this case, the valve 12 will be opened again, bringing it back into its first operating position, before the complete stoppage of the screening drum 5. As will be more clearly understood hereinafter, in the present form of embodiment the operating position of the valve 12 depends on the angular position of the drum 5 about its axis X of rotation and, if the drum stopped in an angular position in which the valve 12 is closed, it would no longer be able to resume rotation except via manual action.

The valve 12 comprises a shutter 13 moving between a first position in which the shutter 13 is extended (FIGS. 3 and 5) and the valve 12 is open, and a second position in which the shutter 13 is partially retracted inside the valve 2 (FIGS. 2 and 4) so as to partially close the valve 12.

The rotation unit further comprises detector means 15, 16 for detecting an angular position of the drum 5, cooperating with the switching means 12 in such a way that the rotation unit is automatically switched into the second operating mode in the region of at least one portion of a revolution of rotation of the drum 5 and is then brought into the first mode again, when the rotation of the drum passes beyond that portion of a revolution.

According to the present form of embodiment, the detector means and the switching means are provided by means of the above-mentioned actuator means 15 and counter-means 16 for actuation of the rotation unit, cooperating with one another in order to bring the shutter 13 into the first and the second position during respective portions of a revolution of rotation of the screening drum 5 about its axis X of rotation.

The actuator means 15 comprise one end 15*a* of the shutter 13, provided with a roller 17, rotatably secured to the end 15*a* and able to abut against the actuator counter-means 16 in order to urge the shutter 13 into the second position in which the valve 12 is at least partially closed.

The actuator means 15 also comprise resilient recall means (not shown, being inside the valve) acting on the shutter 13 in order to urge it into the first position in which the valve 12 is open.

The counter-means 16 comprise at least one flange 18 (two flanges in the exemplary embodiment of the appended drawings) rigid with the screening drum 5, in the region of the minor base 20*b* of the frustoconical portion 7, protruding therefrom in a radial direction with respect to the axis X of rotation in such a way as to be able to abut against the roller 17. The flange 18 is circumferentially extended about the axis X through an angle corresponding to a portion of one revolution of rotation of the screening drum 5 in which the flange 18 comes into contact with the roller 17 and urges the end 15*a* in such a way as to hold the shutter in the second position of partial closure of the valve 12. In the region of the remaining portions of a revolution of rotation of the screening drum 5, in which the flange 18 does not come into contact with the roller 17, the resilient means of the actuator means 15 act on the shutter 13 in such a way as to bring it into the first position in which the valve 12 is open.

In the exemplary embodiment of the appended drawings, the two flanges 18 are diametrically opposed and each has an angular extension about the axis X equal to an angle A of approximately 90°, being interposed between two angular sections devoid of flanges, having an angular extension equal to an angle B of approximately 90°. In this way, in the present example, two portions A are defined within which the shutter 13 is positioned in the second operating position.

In general, for the purposes of the present invention, any number of flanges may be used, provided that they extend overall through an angle of less than 360°, so that each revolution of rotation of the screening drum 5 is sub-divided into at least a first portion in which the valve 12 is in the first, open position and at least a second portion in which valve 12 is in the second, closed position.

Each flange 18 comprises two opposed flat surfaces 21*a,b*, which are in the shape of a circular arc portion of angular extension equal to the angle A, respectively facing towards the shutter 13 and on the opposite side. At the opposite ends of each flange 18 are defined two flanks 22*a,b* constituted by two respective flat radial surfaces.

The flanges 18 interact with the roller 17 according to a coupling of the cam type.

In practice, when the roller 17 comes into contact with one of the flanges 18 in the region of one of the flanks 22*a,b* it rolls on the latter and then on the flat surface 21*a*, bringing the shutter 13 into the second, closure position of the valve 12. After the screening drum 5 has passed through an angle equal to A, the roller 17 reaches the other of the flanks 22*a,b* and after this has been passed over, the resilient means of the actuator means 15 are free to bring the shutter 13 into the first, open position of the valve 12 until the next contact between the roller 17 and one of the flanges 18.

The present invention makes it possible to control the opening time of the valve 12 and consequently to modulate the speed of the screening drum 5, through the selection of the number of flanges 18 and of their angular extension (angle A), independently of the parameters of the hydraulic system.

The present invention therefore makes it possible to act on the parameters of the hydraulic system in order to impose the highest possible rotation speed so as to maximize operating efficiency, or, the amount of material treated in a predetermined period by the screening bucket 1. The predetermined rotation speed is maintained only when the drum is situated outside the aforesaid portions A of a revolution, being rendered discontinuous however, in particular being periodically reduced, by means of the alternate opening and closing of the valve 12 so as to avoid the drawbacks of the centrifugal effect, or, the compacting of the material along the metal walls 6*a*, 7*a* which would impede the passage through the holes 10 also of the material of a size below the dimensions of the holes 10.

It is however clear that the rotation unit and the detector means may also be provided by means of systems different from that described with reference to the preceding form of embodiment.

In particular, the detection of the angular position of the drum may be effected by means of an encoder or some other similar sensor, in particular of the electromechanical type, which again cooperates with the rotation unit in order to effect the switching thereof when the drum is within predetermined portions of a revolution.

This solution may be particularly advantageous in the case where an electric motor is used in place of a hydraulic drive.

According to a further alternative embodiment of the present invention, shown in FIGS. 9-10, a screening bucket 100 comprises a screening drum 50, which can be secured to the structure 2 and is of a shape similar to that of the drum 5. Consequently, in the following, where possible, when describing the screening drum 50 the same reference numbers will be used as are used for the screening drum 5.

In the screening drum 50, the cylindrical portion 6 and frustoconical portion 7 can be separated from each other, being secured to each other in the region of two respective flanges 26, 27 facing each other, respectively placed in the region of the major base 20*a* of the frustoconical portion 7 and of a first base 25*a* of the cylindrical portion 6 opposed to a second base 25*b* facing towards the inlet opening 3.

The flanges 26, 27 comprise respective pluralities of protuberances 28, 29 extending radially with respect to the axis X of rotation. Each protuberance 28, 29 is provided with respective holes 30, 31, each of the holes 30 of the flange 26 being aligned with a respective hole 31 of the flange 27. Each pair of holes 30, 31 aligned with each other is engaged by a respective threaded coupling formed by a bolt (not shown) passing into both holes 30, 31 of the respective pair.

The cylindrical portion 6 and frustoconical portion 7 may be secured to the structure 2 independently of each other. In particular, a method of assembly according to the present invention provides for securing the frustoconical portion 7 to the base 8 of the structure 2 and then inserting the cylindrical portion 6, securing it to the frustoconical portion 7 by securing the flanges 26, 27.

This makes it possible, with parity of dimensions of the outer structure 2, to construct a larger screening drum 5 and therefore to increase the amount of material that can be worked at each screening cycle, consequently increasing the operating efficiency of the screening bucket.

According to another alternative embodiment of the present invention, the screening drum 50 is used in the screening bucket 1 in combination with the actuator means and counter-means 15, 16. This combination allows a positive synergistic effect, with further improvement of the operating efficiency of the screening bucket thus obtained.

The present invention thus makes it possible to obtain a screening bucket which is capable of remedying the drawback mentioned with reference to the prior art, at the same time obtaining numerous advantages.

These include, in the case of use of a screening drum 50, the fact of being able to obtain a screening bucket which is more compact and therefore more maneuverable. In this case, with parity of dimensions of the screening drum, it is possible to use an outer structure 2 smaller than those normally provided for by the prior art, since in order to insert a one-piece screening drum it is necessary to provide a larger clearance between the drum and the outer structure.

The invention claimed is:

1. A screening bucket (1, 100) comprising:

a support structure (2) which can be secured to a moving arm of an operating machine, a screening drum (5, 50) secured to the structure (2) so that the drum (5, 50) is rotatable with respect to the structure (2) about an axis (X) of rotation, the drum (5, 50) comprising at least one perimetral wall (6*a*, 7*a*) provided with through holes (10) of dimensions such as to allow the passage of rubble of a predetermined size, a rotation unit for the screening drum (5; 50) that imparts a rotational motion to the drum (5; 50) about the axis (X) of rotation, a switching device (12) for the rotation unit, configured to switch the rotation unit between a first operating mode in which the screening drum (5; 50) is set in rotation at a substantially constant predetermined working speed and a second operating mode in which the rotation speed of the screening drum (5; 50) is reduced;

the rotation unit further comprises a detector assembly (15, 16) that detects an angular position of the drum (5; 50) and cooperating with the switching device (12) in such a way that the rotation unit is automatically brought into the second operating mode when the drum (5; 50) is in a region of at least one predetermined portion (A) of a revolution and is then brought back into the first operating mode when the rotation of the drum (5; 50) passes beyond the at least one portion (A) of a revolution.

2. The screening bucket (1, 100) according to claim 1, wherein the rotation unit comprises a hydraulic circuit which can be connected to the screening drum (5, 50) in order to actuate the rotation of the drum (5, 50) about the axis (X).

3. The screening bucket (1, 100) according to claim 2, wherein the switching device comprises a valve (12), associated with the hydraulic circuit and provided with a shutter (13) moving between a first position, in which the valve (12) is open in order to connect the hydraulic circuit to the screening drum (5, 50) and to actuate the rotation thereof at the predetermined working speed, and a second position in which the valve (12) is at least partially closed in order to at least limit an operating fluid flow rate issuing from the hydraulic circuit in such a way as to reduce the rotation speed of the screening drum (5, 50).

4. The screening bucket (1, 100) according to claim 3, wherein the switching device and the detector assembly comprise an actuator and counter actuator (15, 16) for the valve (12), cooperating with one another to bring the shutter (13) into the first and second positions during respective portions (A, B) of a revolution of rotation of the drum (5; 50) about the axis (X) of rotation.

5. The screening bucket (1, 100) according to claim 4, wherein the actuator and counter actuator (15, 16) are cam type.

6. The screening bucket (1, 100) according to claim 4 or 5, wherein the actuator (15) that actuates the shutter (13) comprises one end (15*a*) of the shutter (13) which can abut against the counter actuator (16) in order to urge the shutter (13) into the second position and resilient recall member acting on the shutter (13) in order to urge the shutter (13) into the first position.

7. The screening bucket (1, 100) according to claim 4, wherein the counter actuator (16) comprises at least one flange (18) rigid with the screening drum (5, 50) and able to abut against the actuator (15).

8. The screening bucket (1, 100) according to claim 7, wherein the at least one flange (18) extends circumferentially over at least a first portion of a revolution of rotation of the drum (5, 50) in which the flange (18) urges the actuator (15) so as to hold the shutter (13) in the second position.

9. The screening bucket (1, 100) according to claim 1, wherein the detector assembly comprises an angular position sensor of the electromechanical type which can detect the position of the drum (5; 50) about the axis (X) of rotation.

10. The screening bucket (1, 100) according to claim 9, wherein the rotation unit comprises an electric motor the rotation speed of which is reduced when the screening drum (5, 50) is situated in the region of the at least one predetermined portion of a revolution.

11. The screening bucket (1, 100) according to claim 1, wherein the drum (5; 50) comprises a first lateral cylindrical portion (6) and a second frustoconical base portion (7) adjacent to the first cylindrical portion (6), these first and second portions (6, 7) being secured to one another in the region of two respective flanges (26, 27) facing one another.

12. The screening bucket (1, 100) according to claim 11, wherein the flanges (26, 27) are connected to one another by at least one threaded coupling.

13. The screening bucket (1, 100) according to claim 12, wherein the flanges comprise respective pluralities of holes (30, 31), each hole of each flange (26, 27) being aligned with a respective hole of the other flange (26, 27), the aligned holes (30, 31) being engaged by a respective threaded coupling.

14. A method for screening rubble, resulting from excavation or demolition, by a screening bucket (1; 100) comprising a structure (2) which can be secured to the moving arm of an operating machine, and a screening drum (5; 50) rotatably connected to the structure (2) so that it may rotate with respect to the structure (2) about an axis (X) of rotation, comprising the steps of arranging the stone-like material inside the screening drum (2) and setting the drum in rotation at a predetermined speed, reducing the rotation speed of the drum during at least a portion (A) of a revolution of the drum about the axis (X) and of bringing the drum back into rotation at the predetermined speed when the drum passes beyond the at least one portion (A) of a revolution.

15. The method for screening rubble according to claim 14, wherein the screening drum (5; 50) is set in rotation by a hydraulic motor supplied with an operating fluid flow rate by a hydraulic circuit, the rotation speed of the drum (5; 50) being varied by variation of the operating fluid flow rate.

16. The method for screening rubble according to claim 15, wherein the motor of the hydraulic circuit comprises a valve (12) provided with a shutter (13) moving between a first position in which the valve (12) is open in order to connect the hydraulic circuit to the screening drum (5; 50) and a second position in which the valve (12) is at least partially closed in order to at least limit the operating fluid flow rate, the step of varying the flow rate being carried out by bringing the shutter (13) into the second position.

17. The method for screening rubble according to claim 16, wherein the drum (5; 50) comprises flanges (18) which abut against the shutter (13) when the drum (5; 50) is situated in the at least one portion (A) of a revolution, in such a way as to bring it into the second position.

18. The method for screening rubble according to claim 14, wherein the screening drum (5; 50) is set in rotation by an electric motor, the rotation speed of the drum (5; 50) being varied by a variable ratio transmission.

* * * * *